US007406847B2

(12) United States Patent
Yuhi et al.

(10) Patent No.: US 7,406,847 B2
(45) Date of Patent: Aug. 5, 2008

(54) CYLINDER LOCK

(75) Inventors: Kazuo Yuhi, Miyazaki (JP); Takashi Ishitsuka, Miyazaki (JP)

(73) Assignee: Honda Lock Mfg. Co., Ltd., Miyazaki (JP)

( * ) Notice: Subject to any disclaimer, the term of this patent is extended or adjusted under 35 U.S.C. 154(b) by 301 days.

(21) Appl. No.: 11/165,533

(22) Filed: Jun. 24, 2005

(65) Prior Publication Data

US 2006/0000248 A1 Jan. 5, 2006

(30) Foreign Application Priority Data

Jul. 2, 2004 (JP) ..... 2004-196867
Mar. 23, 2005 (JP) ..... 2005-084348

(51) Int. Cl.
*E05B 27/00* (2006.01)

(52) U.S. Cl. ..... 70/360; 70/361; 70/369

(58) Field of Classification Search ..... 70/360, 70/361, 367, 369
See application file for complete search history.

(56) References Cited

U.S. PATENT DOCUMENTS 4,759,204 A * 7/1988 Neyret ..... 70/360
5,263,348 A * 11/1993 Wittwer ..... 70/379 R
5,265,453 A * 11/1993 Konii et al. ..... 70/379 R
5,640,864 A * 6/1997 Miyamoto ..... 70/379 R
5,722,275 A * 3/1998 Price et al. ..... 70/379 R
5,732,580 A * 3/1998 Garnault et al. ..... 70/422
6,098,434 A * 8/2000 Liou ..... 70/360
6,684,672 B2 * 2/2004 Hermansson et al. ..... 70/379 R
6,782,725 B2 * 8/2004 Linares ..... 70/360
6,978,645 B2 * 12/2005 Shimon ..... 70/379 R
7,126,066 B1 * 10/2006 Corcino et al. ..... 200/43.13

FOREIGN PATENT DOCUMENTS

JP 2001-262875 9/2001

* cited by examiner

*Primary Examiner*—Suzanne D Barrett
(74) *Attorney, Agent, or Firm*—Berenato, White & Stavish

(57) ABSTRACT

A cylinder lock capable of normal unlocking operation by an authorized key to a locking mechanism which has been illegally operated by an unauthorized key or the like, the cylinder lock comprising an engaging portion that engages a rotor in the rotational direction only when the cylinder moves toward the unlocking member is disposed to a cylinder to engage the rotor and the cylinder thereby rotating the rotor upon subsequent insertion of an authorized key to connect the rotor and the connection member thereby enabling normal unlocking operation.

8 Claims, 11 Drawing Sheets

BEFORE KEY INSERTION

KEY INSERTED

IN USE OF UNAUTHORIZED KEY

NORMAL

IN USE OF UNAUTHORIZED KEY

WIRE RING TYPE

PLATE RING TYPE

CYLINDER LOCK

FIELD OF THE INVENTION

The present invention concerns a cylinder lock to lock and unlock a door locking device used, for example, in vehicles and, more in particular, it relates to a cylinder lock capable of preventing illegal unlocking of the locking device.

STATEMENT OF RELATED ART

A cylinder lock generally comprises a housing having an engaging groove and fixed to a base body such as a vehicle body, a rotor having a retractable tumbler provided rotationally in the housing and an unlocking member connected with a smaller diametrical portion of the rotor and operationally associated with a locking device. In the constitution described above, when an authorized key is inserted to rotate the rotor, the tumbler is retracted from the outer circumferential surface of the rotor and the rotor rotates in the housing. Therefore, the unlocking member also rotates together with the rotor making it possible to lock and unlock the locking device by way of a transmission member such as a rod.

On the contrary, when an unauthorized key or tool is inserted to the cylinder lock, since the tumbler protruding from the rotor is kept engaged to the engaging groove of the housing, the rotor does not rotate and illegal unlocking of the locking device is inhibited. However, in a case where the rotor is compulsorily rotated in this state, the tumbler in engagement with the engaging groove of the housing is possibly broken to illegally unlock the locking device.

In view of the above, it has been proposed a cylinder lock having a housing secured to a base body, a cylinder incorporated in the housing, a rotor having a tumbler capable of protruding and retracting to and from the cylinder and rotating in the cylinder when the tumbler is retracted from the cylinder by insertion of an authorized key, a connection member movable in the axial direction together with the cylinder and detachably fitted to the rotor, an unlocking member engaged to the connection member such that it can rotate integrally with the connection member and connected by way of a transmission member to a locking device, cam means disposed between the housing and the cylinder for moving the cylinder to the unlocking member and releasing the connection between the connection member and the rotor, and a spring for resiliently energizing the connection member in the direction fitting to the rotor (refer to JP-A No. 13-262875).

In the constitution of the cylinder lock of the prior art described above, in a case where the rotor is rotated by an unauthorized key, the cylinder is rotated together and axially moves in the direction toward the unlocking member, that is, toward the rear end of the rotor and, at the same time, the connection member also moves axially toward the direction of the rear end. Thus, engagement between the connection member and the rotor is released and illegal unlocking of the locking device can be prevented. However, in a case where the rotor is left at a position other than the key insertion/withdrawal position, the released state between the rotor and the connection member is kept as it is. Then, even when the authorized key is inserted and turned at the next time, only the rotor rotates with no rotation of the cylinder and, accordingly, this results in a problem of making normal unlocking operation impossible since the connection member is not connected with the rotor.

Further, the cylinder lock described above involves a problem of requiring complicate operation for assembling a number of members and requiring a special or exclusive jig.

SUMMARY OF THE INVENTION

The present invention has been accomplished in view of the foregoing problems and it intends to provide a cylinder lock capable of preventing illegal unlocking of the locking device and enabling normal unlocking operation even after the use of an unauthorized key or tool, as well as enabling easy and simple assembling operation for a number of members.

A cylinder lock according to the present invention comprises a housing secured to a base body, a cylinder incorporated in the housing, a rotor having a tumbler capable of protruding and retracting to and from the cylinder and rotating in the cylinder when the tumbler is retracted from the cylinder by insertion of an authorized key, a connection member movable in the axial direction together with the cylinder and detachably fitted to the rotor, an unlocking member engaged to the connection member such that it can rotate integrally with the connection member and connected by way of a transmission member to a locking device, cam means disposed between the housing and the cylinder for moving the cylinder to the unlocking member and releasing the connection between the connection member and the rotor, and a spring for resiliently energizing the connection member in the direction fitting to the rotor, wherein an engaging portion that engages the rotor in the rotational direction only when the cylinder moves toward the unlocking member is provided to the cylinder.

In the cylinder lock described above, the engaging protrusion of the rotor for engagement with the engaging portion provided to the cylinder may also serve as a fitting engagement with the connection member.

In a preferred embodiment of the cylinder lock according to the invention, the connection member, the spring, and the unlocking member are constituted by previously assembling then integrally.

In another preferred embodiment of the cylinder lock, a collar is interposed between the connection member and the unlocking member, and the collar is engaged to the connection member and the unlocking portion thereby assembling the members integrally.

In a further preferred embodiment of the cylinder lock, a groove formed to the top end of the rotor on the side of the unlocking member and a clip member previously attached detachably to the unlocking member detachably are engaged and assembled integrally.

In a further preferred embodiment of the cylinder lock, the clip member is attached detachably to the unlocking member and disposed inward of the spring.

The cylinder lock according to the present invention has an advantageous effect capable of preventing illegal unlocking of the locking device in a case where the rotor is rotated by illegal key operation. That is, when the rotor should rotate upon illegal key operation, the cylinder moves axially by way of the cam means in the direction to the rear end of the rotor and, at the same time, the connection member also moves axially to the direction of the rear end to release the fitting between the connection member and the rotor thereby inhibiting illegal unlocking.

Particularly, it has an excellent effect capable of normal unlocking operation even after the rotor has been left by illegal key operation at a position other than the key inserting/withdrawal position. That is, when the authorized key is inserted next time, this rotates the rotor thereby rotating the cylinder that is engaged with the rotor and also axially moves the connection member toward the rotor thereby fitting and connecting the connection member and the rotor to enable normal unlocking.

Further, in the preferred embodiment, since the connection member, the spring, and the unlocking member are constituted by previously assembling them integrally, it has an excellent effect capable of easily assembling the pre-assembled connection member, spring and the unlocking member to the housing.

Further, in a case where the clip member is previously mounted detachably to the unlocking member, since the rotor and the unlocking member can be engaged in one-touch operation, it has an excellent effect of improving the assembling operation efficiency for the cylinder lock.

Further, in a case where the clip member is disposed inward of the spring member and attached to the unlocking member, the axial length of the assembled connection member, the spring, and the unlocking member can be shortened.

DESCRIPTION OF THE ACCOMPANYING DRAWINGS

FIG. 4A to FIG. 4C are explanatory cross sectional views for the key operation to the cylinder lock according to the embodiment of the invention, in which FIG. 4A shows the state before key insertion, FIG. 4B shows the state where a key is inserted, and FIG. 4C shows the state where an unauthorized key has been used;

FIG. 9A and FIG. 9B are explanatory cross sectional views for key operation to the cylinder lock according to the embodiment of the present invention in which FIG. 9A shows a state of normal key operation and FIG. 9B shows a state of illegal key operation;

DESCRIPTION OF PREFERRED EMBODIMENTS OF THE INVENTION

Figure 1:
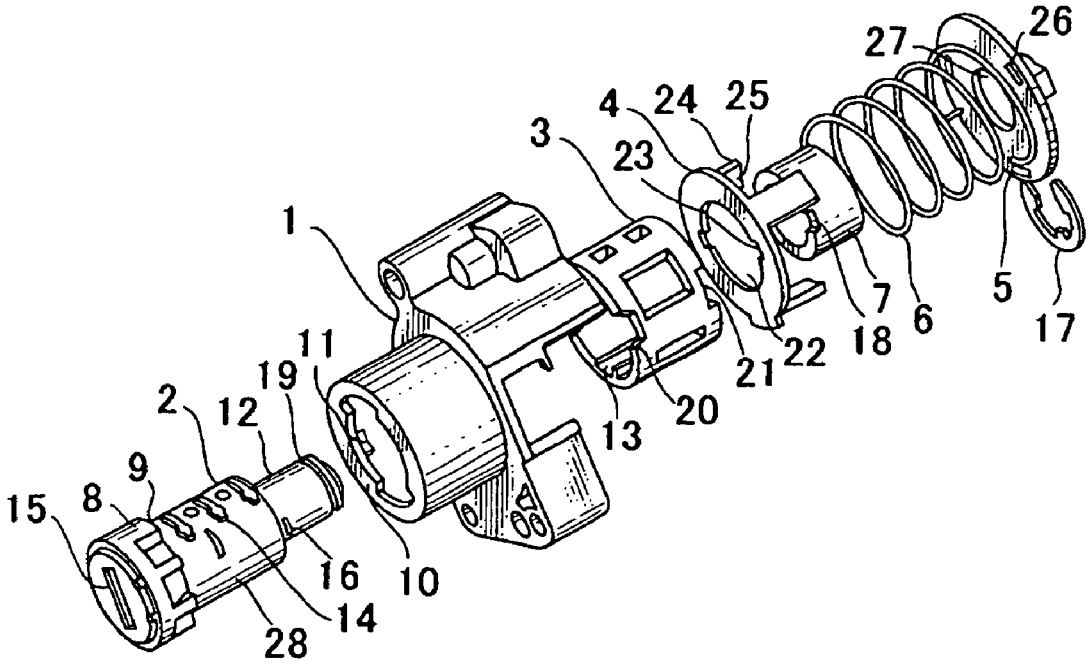
FIG. 1 is an exploded perspective view showing a cylinder lock according to a preferred embodiment of the present invention.

The present invention is to be described with reference to preferred embodiments shown in the drawings.

Embodiment 1 (FIG. 1 to FIG. 4)

Figure 2:
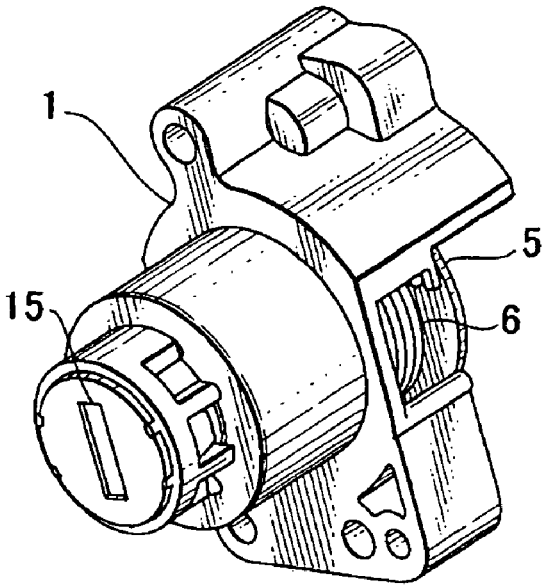
FIG. 2 is a perspective view of the cylinder lock shown in FIG. 1.

As shown in FIG. 1 and FIG. 2, a cylinder lock according to Embodiment 1 of the present invention comprises a housing 1 secured to an opening/closing portion of a vehicle as a base body, a rotor 2 of a diametrically stepped shape rotatably mounted in the housing 1 and having protrudable and retractable tumblers, a cylindrical cylinder 3 rotatably disposed between the rotor 2 and the housing 1, an unlocking member 5 connected to the rear end of the rotor 2, a connection member 4 and a return spring 6 fitted detachably to the rear end of the rotor 2, and a collar 7 disposed between the connection member 4 and the return spring 6.

Referring more specifically to each of the constituent elements in FIG. 1, abutting portions 10 opposed to each other that abut against an abutting surface 9 of a flange 8 of the rotor 2 are formed circumferentially on the side edge at the front end of the housing 1. Trapezoidal protruded cams 11 opposed to each other are formed circumferentially near the abutting portions 10. The rotor 2 is rotatably inserted in the housing 1 from the frontal end, and the axial movement of the rotor 2 is regulated by the abutment between the abutting portions 10 of the housing 1 and the abutting surface 9 of the rotor 2.

Tumblers 14 for engagement with engaging grooves 13 to be described later are disposed protrudably and retractably in the rotor 2, and a key slot 15 is formed at the frontal surface of the flange 8. When an authorized key is inserted into the key slot 15, the tumblers 14 are retracted to be disengaged from the engaging grooves 13 and, in this disengaged state, locking or unlocking by the rotation of the rotor 2 due to normal key operation is possible.

Rotor 2 has a larger diametrical portion 28 on the frontal portion and a smaller diametrical portion 12 on the rearward portion, each portion being extended from the flange 8. A pair of engaging protrusions 16 are formed to the smaller diametrical portion 12 in the circumferential direction in the vicinity of the larger diametrical portion 28, and they engage with engaging recesses 23 of the connection member 4 and the engaging recesses 18 of the collar 7 that fits the connection member 4 to be described later. Further, a circumferential groove 19 that extends in the circumferential direction is formed for fitting an E-ring 17 at the rear end of the smaller diametrical portion 12.

The cylinder 3 is attached rotatably to the larger diametrical portion 27 of the rotor 2. Cam grooves 20 are formed to the frontal end surface of the cylinder 3, and the protruded cams 11 of the housing 1 engage the cam grooves 20. The shape of the cam face of each cam groove 20 is formed as a concave portion complementary with the protruded cam 11, by which the cylinder 3 moves axially by way of the protruded cam 11 by the height of the protruded cam in the axial direction along with the rotation of the cylinder 3.

Engaging grooves 13 extending axially are opposed to each other at the inner surface of the cylinder 3, and the tumblers 14 protruding out of the circumferential surface of the rotor 2 engage the engaging grooves 13. A pair of engaging portions 21 that engage the engaging protrusions 16 of the rotor 2 are formed at the rear end of the cylinder 3 and they engage in the rotational direction of the rotor 2.

A cylindrical resin collar 7, a connection member 4 abutting against the rear end of the cylinder 3, and a return spring 6 for always resiliently energizing the connection member 4 toward the cylinder 3 are successively attached to the smaller diametrical portion 12 of the rotor 2. The rear end of the return spring 6 abuts against the frontal surface of the unlocking member 5. The connection member 4 is formed into a disk-shape having an insertion hole 22. Engaging recesses 23 corresponding to the engaging protrusions 16 of the smaller diametrical portion 12 of the rotor 2 are formed to the inner surface of the insertion hole 22, by which the engaging protrusions 16 of the smaller diametrical portion 12 of the rotor 2 are engaged detachably to the engaging recesses 23 of the connection member 4.

Engaging recesses 18 for engagement with the engaging protrusions 16 of the rotor 2 are disposed being opposed to each other at the frontal end of the resin collar 7, and the smaller diametrical portion 12 of the rotor 2 is inserted for engagement. Further, the connection member 4 is fitted rotationally to the resin collar 7.

At the back of the connection member 4, three axially extending engaging protrusions 24 are disposed each at a predetermined position. The inner surface 25 of the engaging protrusions of the connection member 4 constitutes an abutting surface for the return spring 6. The resin collar 7 is disposed between the return spring 6 and the rotor 2 for preventing rusting. Further, the return spring 6 always energizes the connection member 4 resiliently to the direction of the housing 1 and is adapted to return the connection member 4 under rotation to the initial rotation position relative to the housing 1.

In the unlocking member 5 disposed behind the return spring 6, are formed engaging holes 26 for engagement with three engaging protrusions 24 of the connection member 4 and an insertion hole 27 for inserting the smaller diametrical portion 12 of the rotor 2. The smaller diametrical portion 12 of the rotor 2 is rotatably inserted through the insertion hole 27 and an anti-slip off E-ring 17 is fitted to the circumferential groove 19 of the smaller diametrical portion 12.

The engaging protrusions 24 of the connection member 24 are engaged axially movably but not rotatably in the engaging holes 26 of the unlocking member 5. That is, the unlocking member 5 is integrally rotatable together with the connection member 4 only in the circumferential direction along with rotation of the connection member 4. Further, a wire (not illustrated) is attached to the unlocking member 5 and is connected with a locking device (not illustrated).

Figure 4A:
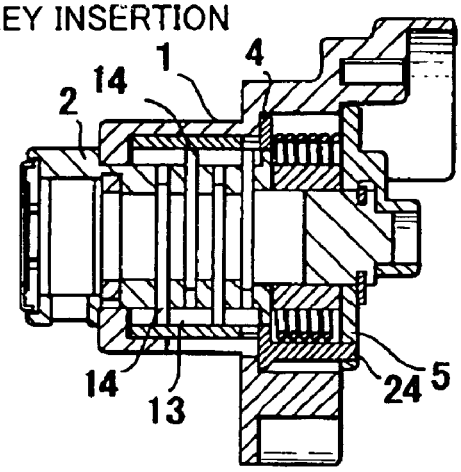
Figure 4B:
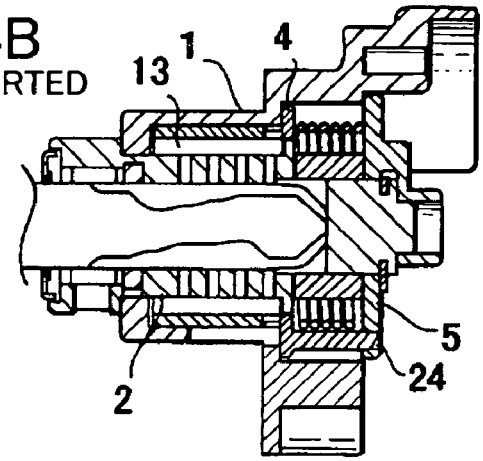

In the constitution described above, when an authorized key is inserted into the key slot 15 and put to turning operation, since the tumblers 14 retract as shown in FIG. 4B, they are out of engagement with the engaging grooves 13 to allow the rotor 2 to rotate. The rotor 2, the collar 7, and the connection member 4 rotate together, and the unlocking member 5 also rotates. Thus, locking or unlocking is possible in accordance with the rotational position of the rotor 2.

On the other hand, in a case where a turning operation is undertaken by using an unauthorized key or tool, since the tumblers 14 are left in engagement with the engaging groove 13 of the cylinder 3, the cylinder also rotates in association with the rotor 2 and moves axially by the cam means in the direction of the unlocking member 5.

Accordingly, fitting connection between the connection ember 4 and the rotor 2 is released and the rotor 2 rotates idly. As described above, since the engagement between the connection member 4 and the rotor 2 is released, the connection member 4 does not rotate even when the rotor 2 rotates, and since the unlocking member 5 engaging the connection member 4 does not rotate as well, illegal unlocking of the locking device by the unauthorized key or tool can be prevented.

Figure 3:
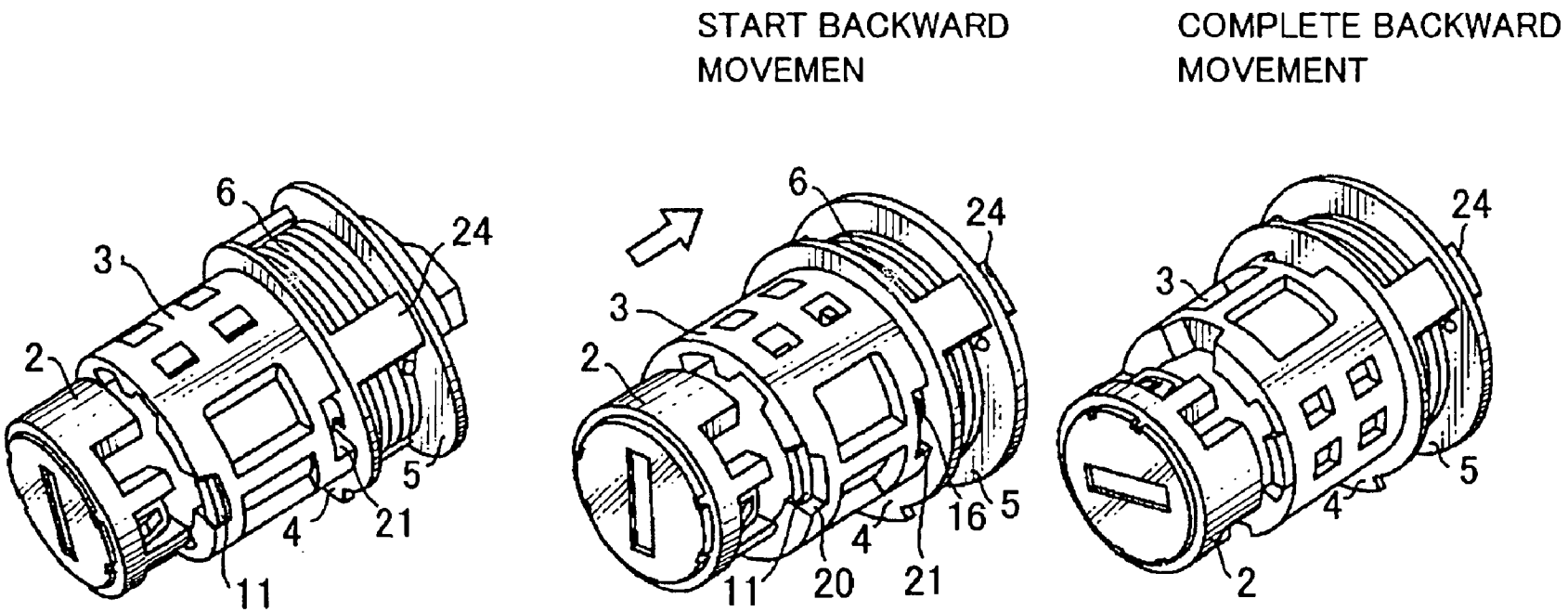
FIG. 3 is an explanatory perspective view of the cylinder lock showing the state in which the cylinder axially moves rearward.
Figure 4C:
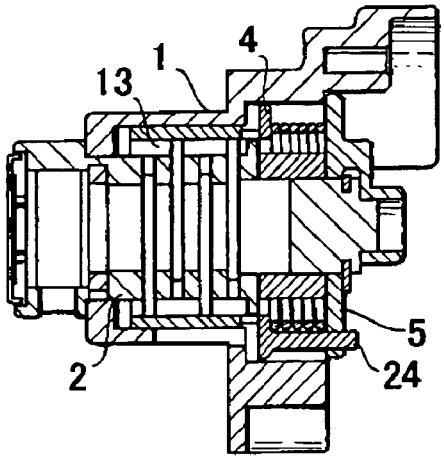

In this embodiment, even in a case where the unauthorized key or tool has been drawn out at a position other than the key insertion/withdrawal position and left, as shown in FIG. 3 and FIG. 4, since the connection member 4 moves axially in the direction of the unlocking member 5 together with the cylinder 3 and the engaging protrusions 16 of the rotor 2 are disengaged from the engaging recesses 23 of the connection member 4 and in engagement with the engaging portions 21 of the cylinder 3.

Accordingly, when the authorized key is inserted next time to the key slot 15 to turn the rotor 2, the cylinder 3 also rotates, the cylinder 3 moves axially in the direction of the housing 1 by the cam means, and the connection member 4 moves axially together with the cylinder 3 in the direction of the housing 1 by the axial resiliency of the return spring 6 to fit to the rotor 2, so that normal unlocking operation is possible.

As described above, Embodiment 1 according to the present invention can prevent illegal unlocking of the locking device in a case where the rotor is rotated by an illegal key operation, since the cylinder moves axially by way of the cam means in the direction to the rear end of the rotor and, at the same time, the connection member also moves axially to the direction of the rear end to release the fitting connection between the connection member and the rotor.

Particularly, even after the unauthorized key has been used and the rotor has been left at a position other than the key inserting/withdrawal position, subsequent normal unlocking operation is possible. That is, when the authorized is inserted at the next time to rotate the rotor, this rotates the cylinder in engagement with the rotor and axially moves the connection member toward the rotor thereby fitting and connecting the connection member and the rotor.

Embodiment 2 (FIG. 5 to FIG. 15)

Embodiment 2 and attendant modified embodiments according to the present invention are to be described with reference to the drawings.

Embodiment 2, etc. have a feature in which the connection member, the spring, and the unlocking member in Embodiment 1 are previously assembled integrally for facilitating the assembling operation of the cylinder lock.

Figure 5:
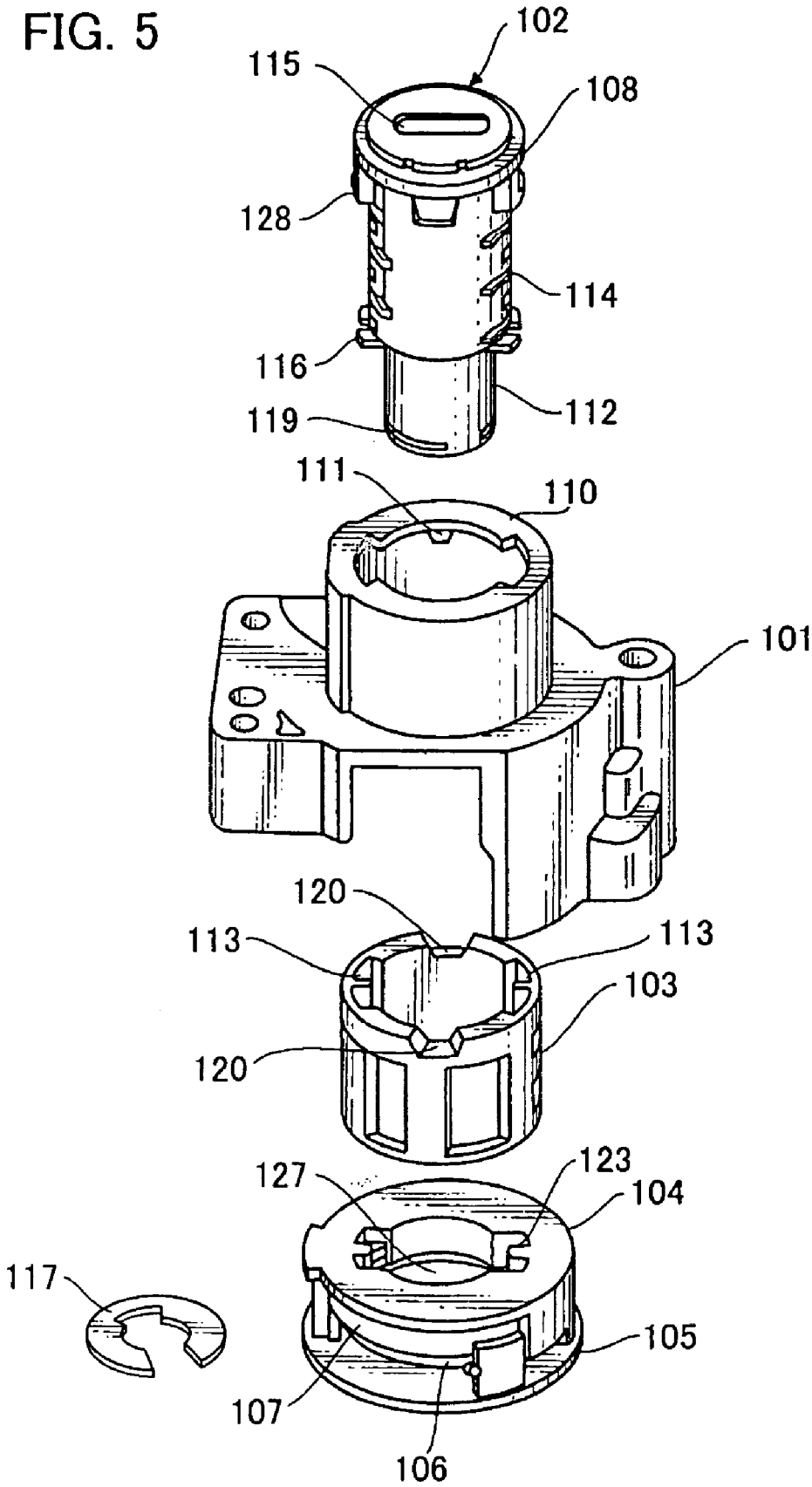
FIG. 5 is an exploded perspective view showing a cylinder lock according to another preferred embodiment of the present invention.
Figure 6:
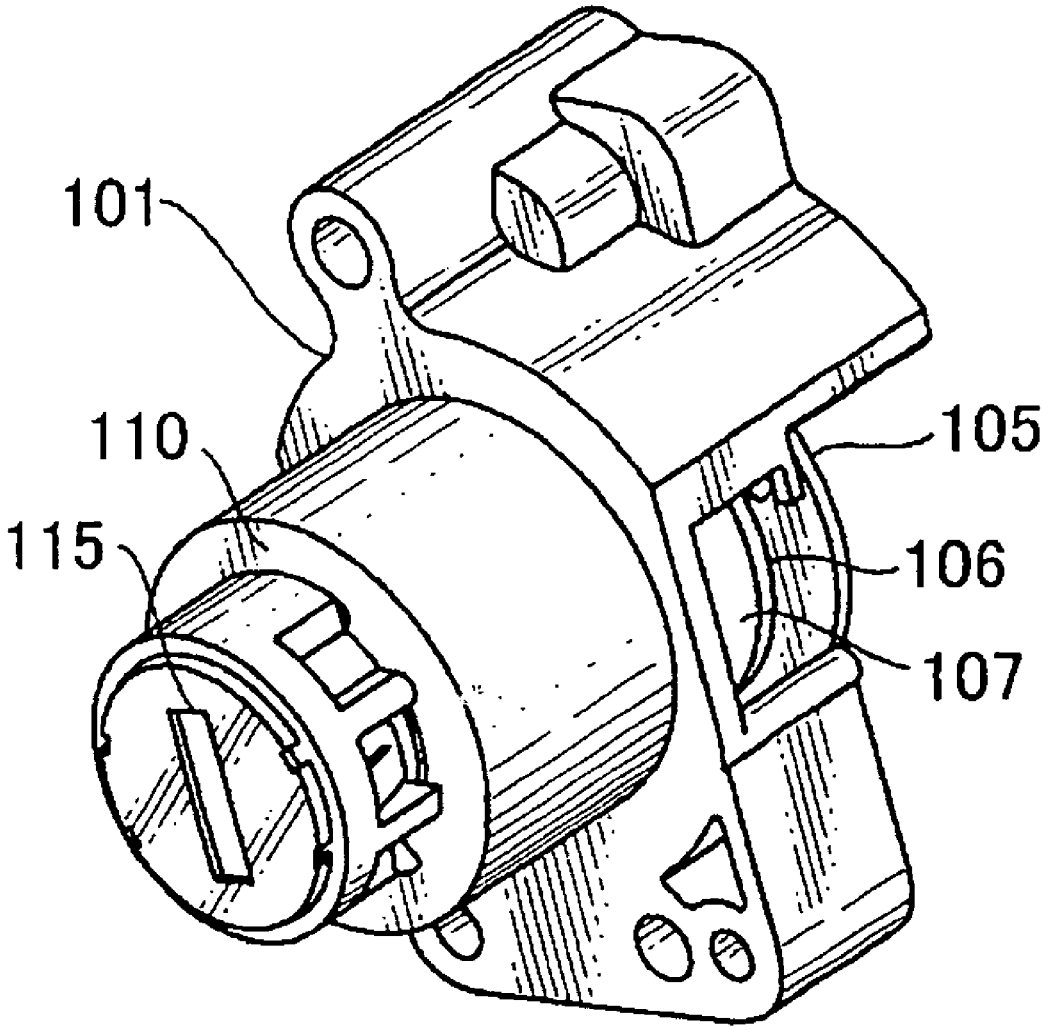
FIG. 6 is a perspective view of the cylinder lock shown in FIG. 5.

As shown in FIG. 5 and FIG. 6, a cylinder lock according to Embodiment 2 of the present invention comprises a housing 101 secured to an opening/closing portion of a vehicle as a base body, a rotor 102 of diametrically a stepped shape rotatably mounted in the housing 101 and having protrudable and retractable tumblers, a cylindrical cylinder 103 rotatably disposed between the rotor 102 and the housing 101, an unlocking member 105 connected to the rear end of the rotor 102, a connection member 104 and a return spring 106 fitted detachably to the rear end of the rotor 102, and a collar 107 disposed between the connection member 104 and the return spring 106.

Figure 7:
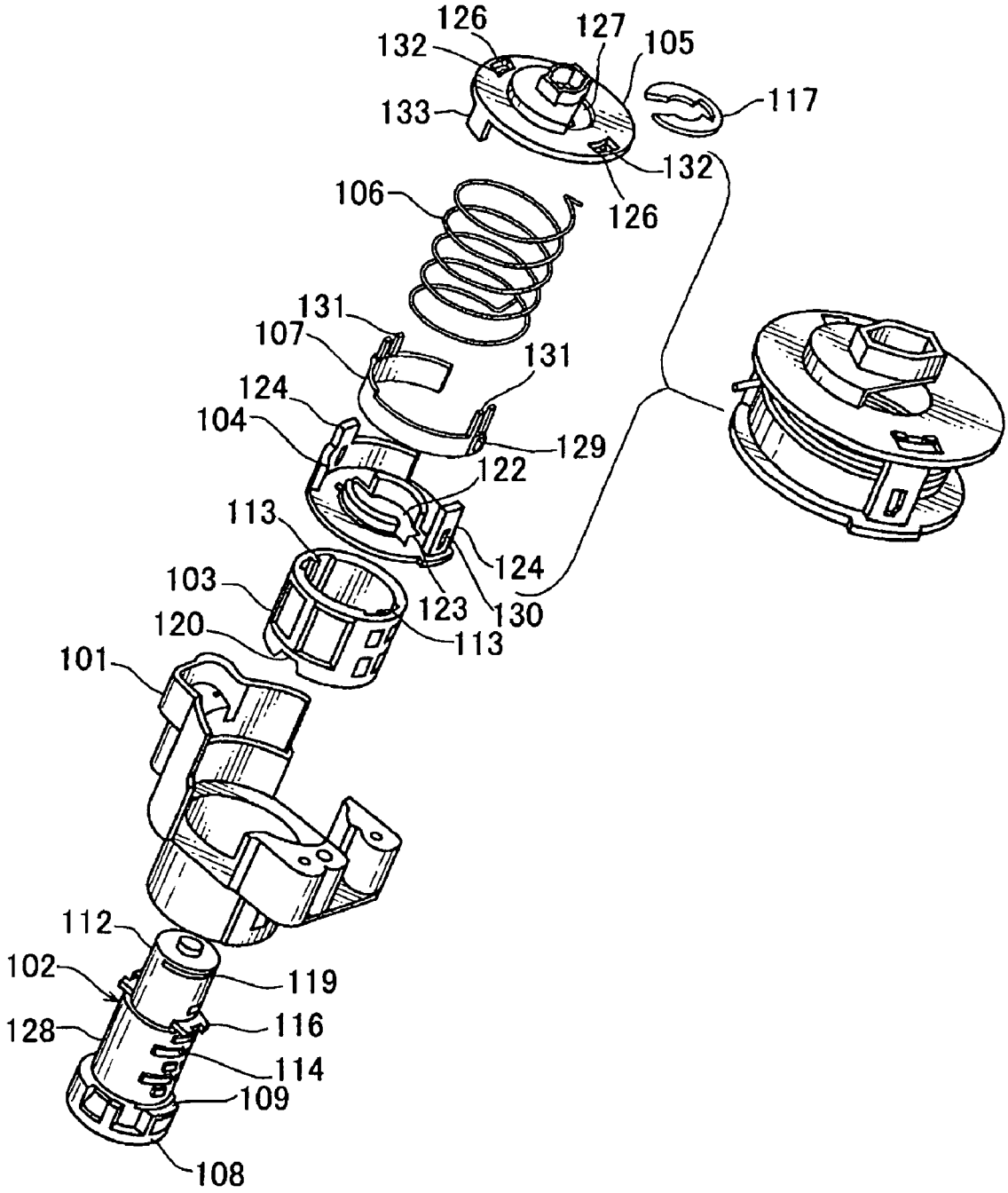
FIG. 7 is a detailed exploded perspective view for FIG. 5.

Referring more specifically to each of the constituent elements in FIG. 5 and FIG. 7, abutting portions 110 opposed to each other that abut against an abutting surface 109 of a flange 108 of the rotor 102 are formed circumferentially on the side edge at the front end of the housing 101. Trapezoidal protruded cams 111 opposed to each other are formed circumferentially near the abutting portions 110. The rotor 102 is rotatably inserted in the housing 101 from the frontal end, and the axial movement of the rotor 102 is regulated by the abutment between the abutting portions 110 of the housing 101 and the abutting surface 109 of the rotor 102.

As shown in FIG. 5, tumblers 114 for engagement with engaging grooves 113 to be described later are disposed protrudably and retractably in the rotor 102, and a key slot 115 is formed at the frontal surface of the flange 108. When an authorized key is inserted into the key slot 115, the tumblers 114 are retracted to be disengaged from the engaging grooves 113 and, in this disengaged state, locking or unlocking by the rotation of the rotor 102 due to normal key operation is possible.

Rotor 102 has a larger diametrical portion 128 on the frontal side and a smaller diametrical portion 112 on the rearward portion, each portion being extended from the flange 108. A pair of co-rotation protrusions (hereinafter as engaging protrusions) 116 are formed to the smaller diametrical portion 112 in the circumferential direction in the vicinity of the larger diametrical portion 128, and they engage with engaging recesses 123 of the connection member 104 and the engaging recesses 118 of the collar 107 that fits the connection member 104 to be described later. Further, a circumferential groove 119 that extends in the circumferential direction is formed for fitting an E-ring 117 at the rear end of the smaller diametrical portion 112.

The cylinder 103 is attached rotatably to the larger diametrical portion 128 of the rotor 102. Cam grooves 120 are formed to the frontal end surface of the cylinder 103, and the protruded cams 111 of the housing 101 engage the cam grooves 120. The shape of the cam face of each cam groove 120 is formed as a concave portion complementary with the protruded cam 111, by which the cylinder 103 moves axially by way of the protruded cam 111 by the height of the protruded cam in the axial direction along with the rotation of the cylinder 103.

Two rows of engaging grooves 113 extending axially are opposed to each other at the inner surface of the cylinder 103, and two rows of tumblers 114 protruding out of the circumferential surface of the rotor 102 engage the engaging grooves 113.

The connection member 104 abutting against the rear end of the cylinder 103, the return spring 106 for always resiliently energizing the connection member 104 toward the cylinder 3, the substantially C-shaped collar 107 made of resin, and the unlocking member 105 are constituted integrally being engaged by engaging means disposed to the collar 107 to be described later to the smaller diametrical portion 112 of the rotor 102.

The connection member 104 is formed into a disk-like shape having an insertion hole 122. A pair of engaging recesses 123 corresponding to the engaging protrusions 116 of the smaller diametrical portion 112 of the rotor 102 are formed to the inner surface thereof, by which the engaging protrusions 116 of the smaller diametrical portion 112 are engaged detachably to the engaging recesses 123 of the connection member 104.

At the back of the connection member 104, axially extending engaging protrusions 124 are disposed at predetermined positions. Engaging holes 130 for engagement with a pair of engaging protrusions 129 formed to the outer circumferential surface of the color 107 are disposed each about at the center of each engaging protrusion 124. The inner circumferential surface of the engaging protrusions 124 of the connection member 104 and the outer circumferential surface of the collar 107 constitute abutting surfaces.

The inner circumferential surface of the collar 107 constitutes the abutting surface for the return spring 106. A pair of hooked engaging portions 131 are opposed to each other and extend axially of the engaging protrusions 129 to the rear end of the collar 107. Further, the return spring 106 is constituted such that it always resiliently energizes the connection member 104 to the direction of the housing 101 and also returns the connection member under rotation 104 to the initial rotation position relative to the housing 101.

In the unlocking member 105 disposed behind the return spring 106, are formed engaging holes 126 for engaging the engaging protrusions 124 of the connection member 104, engaging steps 132 formed within the engaging holes 126 for engaging the hooked engaging portions 131 of the collar 107, and an insertion hole 127 for inserting the smaller diametrical portion 112 of the rotor 102. A leg 133 that engages one end of the return spring 106 is formed to the edge on the frontal surface of the unlocking member 105, which is used for the rotating and compressing operation of the return spring 106 during assembling of the connection member 104, the collar 107, the return spring 106, and the unlocking member 105 to be described later.

The smaller diametrical portion 112 of the rotor 102 is rotatably inserted in the insertion hole 127 and an anti-slip off E-ring 117 is fitted to the circumferential groove 119 of the smaller diametrical portion 112. The engaging protrusions 124 of the connection member 104 and the hooked engaging portions 131 of the collar 107 are engaged axially movably but not rotatably to the engaging holes 126 of the unlocking member 105. That is, the unlocking member 105 is made rotatable integrally with the connection member 104 only in the circumferential direction along with rotation of the connection member 104. Further, a wire (not illustrated) is attached to the unlocking member 105 and is connected with a locking device (not illustrated).

Figure 8:
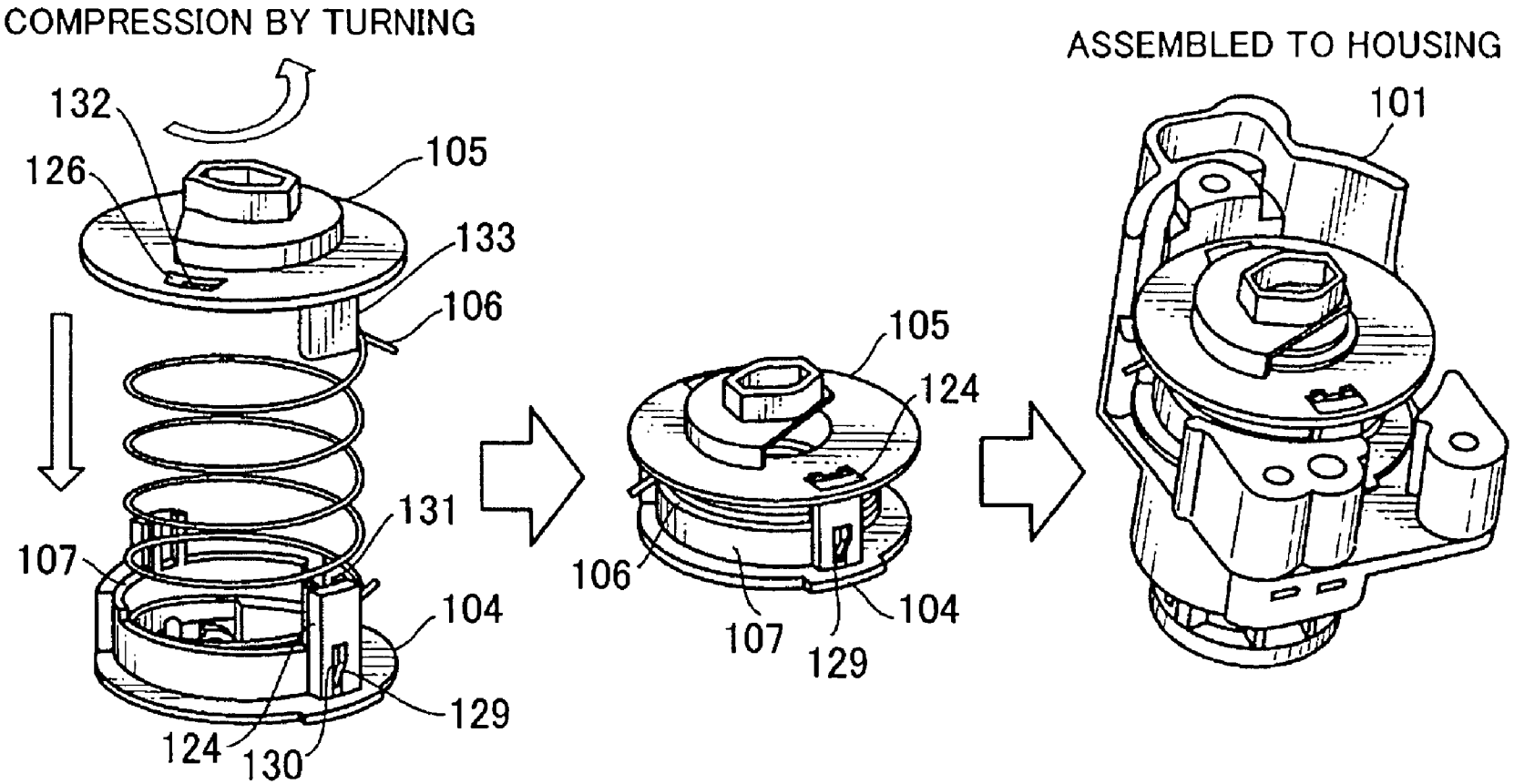
FIG. 8 is a view explaining an assembled state of a connection member, a spring, a collar and a an unlocking member of the present invention.

Then, the assembling operation for the connection member 104, the return spring 106, the collar 107 and the unlocking member 105 is to be described with reference to FIG. 7 and FIG. 8. At first, the collar 107 is inserted in the connection member 104 while being abutted against the inner surface of the engaging protrusions 124, to engage the engaging protrusions 129 of the collar 7 and the engaging holes 130 of the connection member 104. Then, the return spring 106 is inserted being abutted against the inner surface of the collar 107 while engaging one end thereof to the lateral end of the engaging protrusion 124, and the other end of the return spring 106 is engaged to the lateral end of the leg 133 of the unlocking member 105. The spring is compressed in the direction of the connection member 104 while rotating the unlocking member 105, and the engaging protrusions 124 and the hooked engagements 131 are inserted and secured in the engaging holes 126. Since the hooked engagements 131 and the engaging steps 132 are engaged by so-called snap fit, they can be secured easily.

As described above, since the connection member 104, the return spring 106, the collar 107, and the unlocking member 105 are assembled integrally, the cylinder lock according to the present invention can easily be assembled by inserting the rotor 102 from the frontal end of the housing 101, and inserting the connection member 104, the return spring 106, the collar 107, and the unlocking member 105 previously assembled integrally from the rear end of the housing 101, and securing the rotor 102 by the E-ring 117.

In the constitution described above, when an authorized key is inserted into the key slot 115 and a turning operation is conducted, since the tumblers 114 are retracted, engagement with the engaging grooves 113 is released and the rotor 102 rotates. The rotor 102, the collar 107, and the connection member 104 rotate together, and the unlocking member 105 also rotates. Thus, locking or unlocking is possible in accordance with the rotational position of the rotor 102.

On the other hand, in a case of conducting a rotational operation by using an unauthorized key or tool, since the tumblers (not illustrated) are left as they are being engaged with the engaging grooves (not illustrated) of the cylinder 103, the cylinder also rotates in association with the rotor 102 and moves axially by the cam means in the direction of the unlocking member 105, fitting engagement between the connection member 104 and the rotor 102 is released and the rotor 102 rotates idly. As described above, since the engagement between the connection member 104 and the rotor 102 has been released, the connection member 104 does not rotate even when the rotor 102 rotates, and the unlocking member 105 engaging the connection member 104 does not rotate as well, so that illegal unlocking of the locking device by the unauthorized key or tool can be prevented.

Figure 9A:
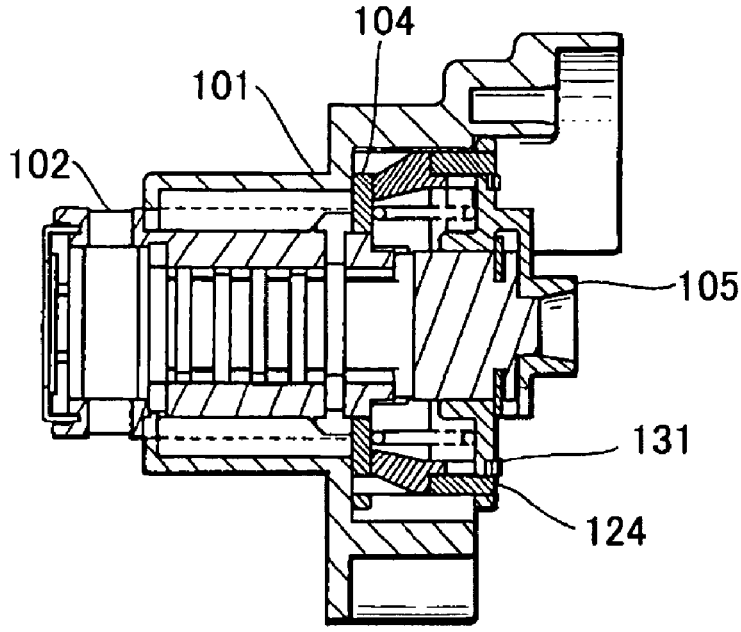
Figure 9B:
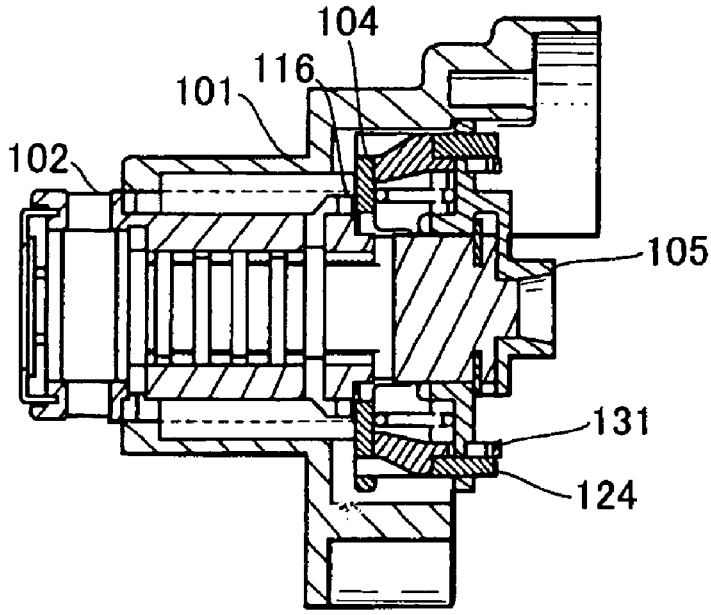

In a state where the unauthorized key or tool is withdrawn at a position other than the key insertion/withdrawal position as shown in FIG. 9B, since the connection member 104 moves axially together with the cylinder 103 in the direction of the unlocking member 105, the engaging protrusions 116 of the rotor 102 are disengaged from the engaging recesses 123 of the connection member 104, and engage the engaging grooves 113 at the inner surface of the cylinder 103.

Accordingly, when the authorized key is inserted next time to the key slot 115 to turn the rotor 102, the cylinder 103 also rotates and the cylinder 103 moves axially in the direction of the housing 101 by the cam means, and the connection member 104 moves axially together with the cylinder 103 in the direction of the housing 101 by the axial resiliency of the return spring 106 and is fitted to the rotor 102. Accordingly, normal unlocking operation is possible.

Figure 10:
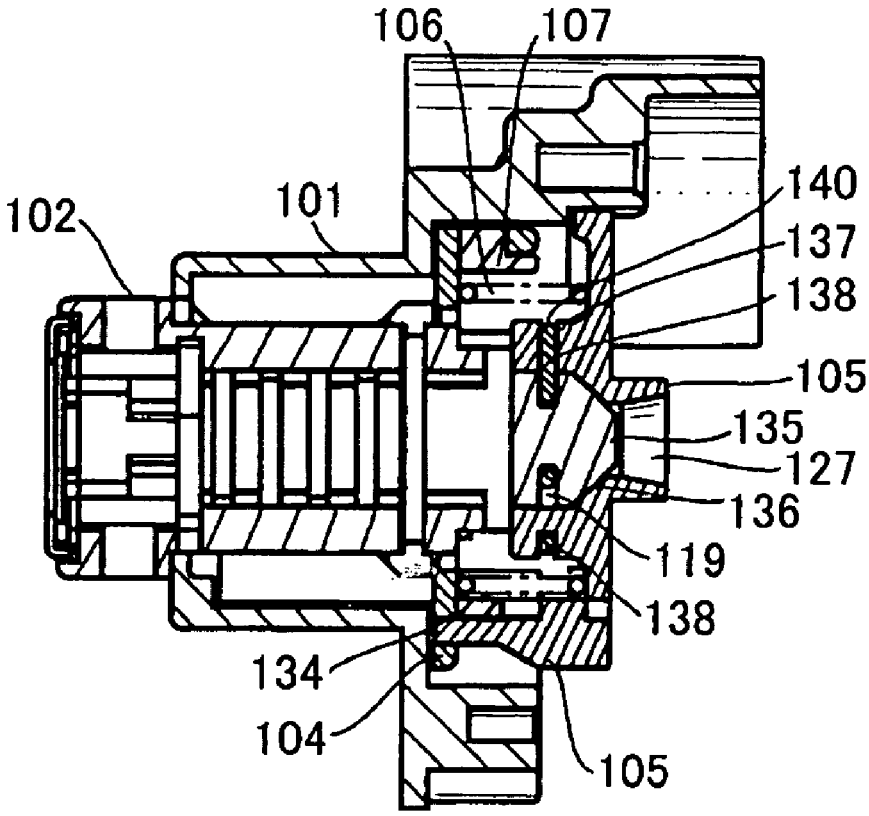
FIG. 10 is an explanatory cross sectional view of a cylinder lock according to a modified embodiment of the present invention.
Figure 11:
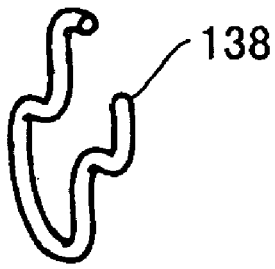
FIG. 11 is a perspective view of a clip ring used in the cylinder lock of FIG. 10.
Figure 14:
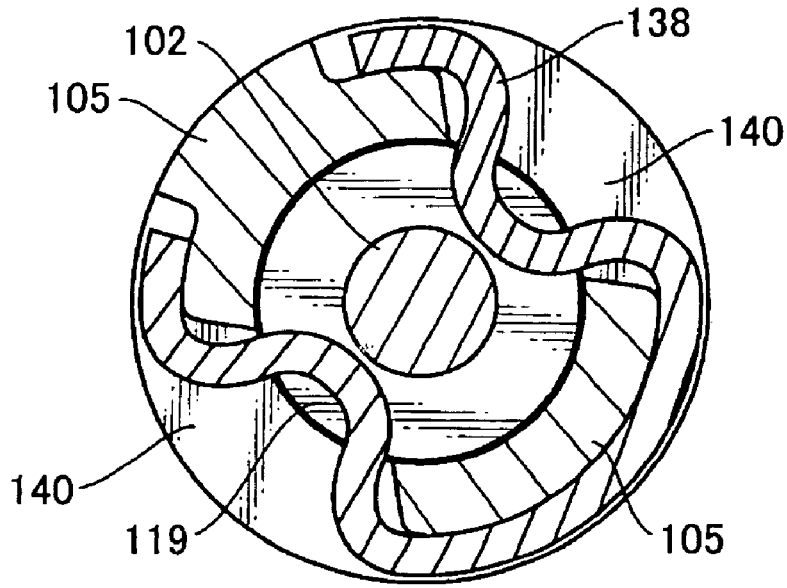
FIG. 14 is a fragmentary cross sectional view of FIG. 10.

In a modified embodiment shown in FIGS. 10, 11, and 14, a connection member 104, a collar 107, a return spring 106 and an unlocking member 105 of a cylinder lock according to the present invention are previously assembled integrally. Further, in this modified embodiment, a leg 133 of the unlocking member 105 engage with engaging hole 134 formed in the connection member 104. Further, an inclined surface 136 that abuts against the top end 135 of the rotor 102 is formed to the inner surface of the insertion hole 127 of the unlocking member 105, a recess 140 is formed to an outer edge 137 of the insertion hole 127 in the direction of the return spring 106, and a clip ring 138 made of a metal wire shown in FIG. 11 is attached thereto.

The top end 135 is substantially in a spindle shape, formed with a circumferential groove in the circumferential direction for engagement with a clip ring 137, and rotatably inserted into the insertion hole 127. The clip ring 138 is formed by bending a metal wire into a substantially guitar-shaped being opened at one end and attached to the recess 140 with the open end being enlarged diametrically.

The cylinder lock is assembled in the same manner as in Embodiment 2, and the connection member 104, the collar 107, the return spring 106, and the unlocking member 105 previously assembled integrally are inserted from the rear end of the housing 101. Since the top end 135 of the rotor 102 is inserted in the direction of the insertion hole 127 while enlarging the clip ring 138 diametrically, the top end 135 abuts against the inclined surface 136, and the clip ring 138 engages under diametrical restriction to the circumferential groove 119, the assembling is completed in one-touch operation.

In addition, since the clip ring 138 is previously attached to the unlocking member 105 inward of the return spring 106, attachment by the E-ring 117 is no more necessary and, since a structure for attaching the E-ring 117 at the back of the unlocking member 104 is not required, the axial length for the assembled connection member 104, the return spring 106, and the unlocking member 105 can be shortened.

Since the key operation to the cylinder lock and the operation of the cylinder lock assembled as described above are identical with those in Embodiment 1, descriptions therefor are omitted.

Figure 12:
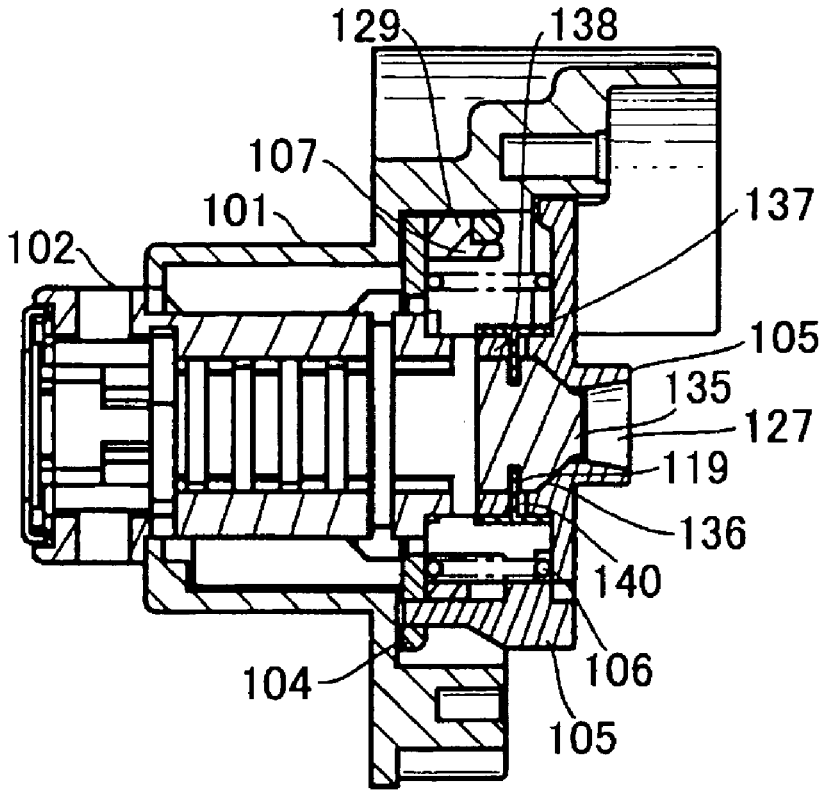
FIG. 12 is an explanatory cross sectional view of a cylinder lock according to a further modified embodiment of the present invention.
Figure 13:
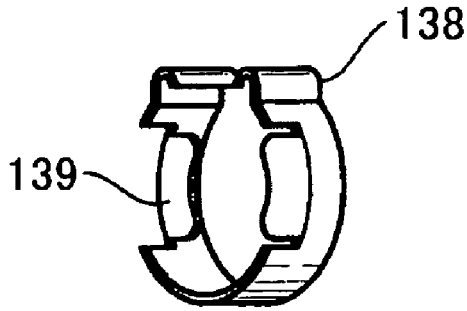
FIG. 13 is a perspective view of a clip ring used in the cylinder lock of FIG. 12.
Figure 15:
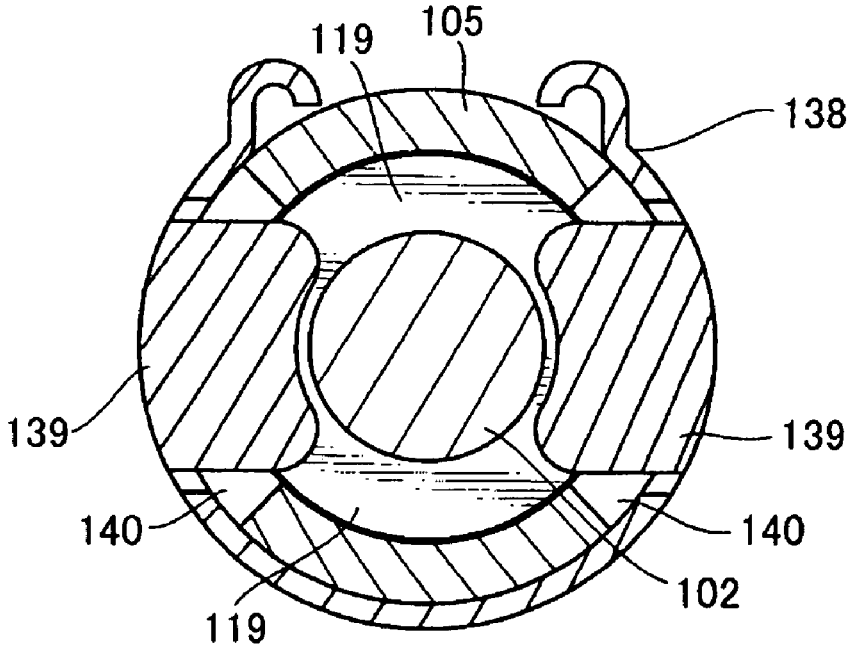
FIG. 15 is a fragmentary cross sectional view of FIG. 12.

In another modified embodiment shown in FIGS. 12, 13, and 15, the clip ring 138 comprises a rectangular metal plate, in which both longitudinal ends are bent each into a predetermined length in the opposite direction and, further, applied with bending fabrication substantially into a cylindrical shape conforming the outer diameter for the outer edge 137 of the unlocking member 105, and bent pieces 139 are formed at opposed positions at the position corresponding to the recesses 140. The clip ring 138, like in Embodiment 2, is previously attached at a position where the bent pieces 139 engage with the recesses 140 of the unlocking member 105 and, further, the connection member 104, the collar 107, the return spring 106, and the unlocking member 105 are assembled integrally.

The cylinder lock is assembled in the same manner as in the embodiment of FIG. 10, and the connection member 104, the collar 107, the return spring 106, and the unlocking member 105 previously assembled integrally are inserted from the rear end of the housing 101 and the top end 135 of the rotor 102 is inserted in the direction of the insertion hole 127 while diametrically enlarging the bent pieces 139 of the clip ring 138 in the radial direction of the ring. Then, the bent pieces 139 engage the circumferential groove 119 to complete the assembling by one-touch operation.

Since the key operation to the cylinder lock and the operation of the cylinder lock assembled as described above are identical with those in the previous embodiments, descriptions therefor are omitted.

In the Embodiment 2 described above, the connection member, the spring, the collar, and the unlocking member can be assembled integrally by the engaging means disposed to the collar. In addition, in a modified embodiment where the clip member is previously attached detachably to the unlocking member, cylinder lock can be assembled by one-touch operation with no requirement for an exclusive jig during assembling operation and the operation efficiency is improved. Further, in a further modified embodiment where the clip member is disposed inward of the spring, the axial length of the assembled connection member, the spring, and the unlocking member can be shortened.

What is claimed is:

1. A cylinder lock comprising;

a housing secured to a base body, a cylinder incorporated in the housing, a rotor having a tumbler capable of protruding and retracting to and from the cylinder and rotating in the cylinder when the tumbler is retracted from the cylinder by insertion of an authorized key, a connection member movable in the axial direction together with the cylinder and detachably fitted to the rotor, an unlocking member engaged to the connection member such that it can rotate integrally with the connection member and connected by way of a transmission member to a locking device, cam means disposed between the housing and the cylinder for moving the cylinder to the unlocking member and releasing the connection between the connection member and the rotor, and a spring for resiliently energizing the connection member in the direction fitting to the rotor, wherein an engaging portion that engages the rotor in the rotational direction only when the cylinder moves toward the unlocking member is provided to the cylinder, whereby the engaging portion provided to the cylinder and a rotor engaging protrusion formed to the rotor are engaged when an unauthorized key is withdrawn out at a position of a key insertion/withdrawn position.

2. A cylinder lock according to claim 1, wherein the engaging protrusion of the rotor for engagement with the engaging portion provided to the cylinder also serves as a fitting engagement with the connection member.

3. A cylinder lock according to claim 1, wherein the connection member, the spring, and the unlocking member are constituted by being previously assembled integrally.

4. A cylinder lock according to claim 3, wherein a collar is interposed between the connection member and the unlocking member, and the collar is engaged to the connection member and the unlocking member thereby assembling the members integrally.

5. A cylinder lock according to claim 3, wherein a groove formed to the top end of the rotor on the side of the unlocking member and a clip member previously attached detachably to the unlocking member are engaged and assembled integrally.

6. A cylinder lock according to claim 5, wherein the clip member is attached detachably to the unlocking member and disposed inward of the spring.

7. A cylinder lock according to claim 2, wherein the connection member, the spring, and the unlocking member are constituted by being previously assembled integrally.

8. A cylinder lock according to claim 1, wherein said engaging portion includes a pair of engaging portions formed at a rear end of the cylinder, said rotor engaging protrusions include a pair of rotor engaging protrusions, said pair of engaging portions engage said rotor engaging protrusions only when the cylinder moves axially relative to the housing.

* * * * *